United States Patent [19]

Long et al.

[11] Patent Number: 4,964,347

[45] Date of Patent: Oct. 23, 1990

[54] SIDE PANEL ASSEMBLY FOR AN AUTO RACK CAR

[75] Inventors: Russell L. Long, Greenville; James D. Hart, Grove City, both of Pa.

[73] Assignee: Trinity Industries, Inc., Dallas, Tex.

[21] Appl. No.: 369,764

[22] Filed: Jun. 22, 1989

[51] Int. Cl.[5] ..... B61D 17/08

[52] U.S. Cl. ..... 105/404; 105/355

[58] Field of Search ..... 105/396, , 404, 409, 105/410, 411, 412, 423, 424, 355; 52/309.2, 823, 578, 393

[56] References Cited

U.S. PATENT DOCUMENTS

| | | | |
|---|---|---|---|
| 2,504,386 | 8/1951 | Webb | 52/823 |
| 3,416,282 | 12/1968 | Daugherty | 52/823 |
| 3,460,860 | 8/1969 | Steven | 52/578 |
| 4,059,056 | 11/1977 | Berryman et al. | 105/409 |

*Primary Examiner*—Robert R. Olszewski
*Assistant Examiner*—Mark T. Le
*Attorney, Agent, or Firm*—Myers & Assoc., Ltd.

[57] ABSTRACT

A railway car side panel assembly with upright support posts forming the side walls of the car wherein painted or galvanized panels are protected from rusting by plastic inserts positioned between the corners of the panels and metal brackets on the posts to prevent vibration-abrasion of the galvanizing or paint and of the corners to rust, the plastic inserts being of flexible plastic material and formed as envelopes pocketing the corners and fitting into the complementary brackets, said envelopes each having a side wall with a retainer bottom snapped over flange edges of the panel to hold the envelope from falling off during assembly with the brackets.

22 Claims, 3 Drawing Sheets

FIG. 1
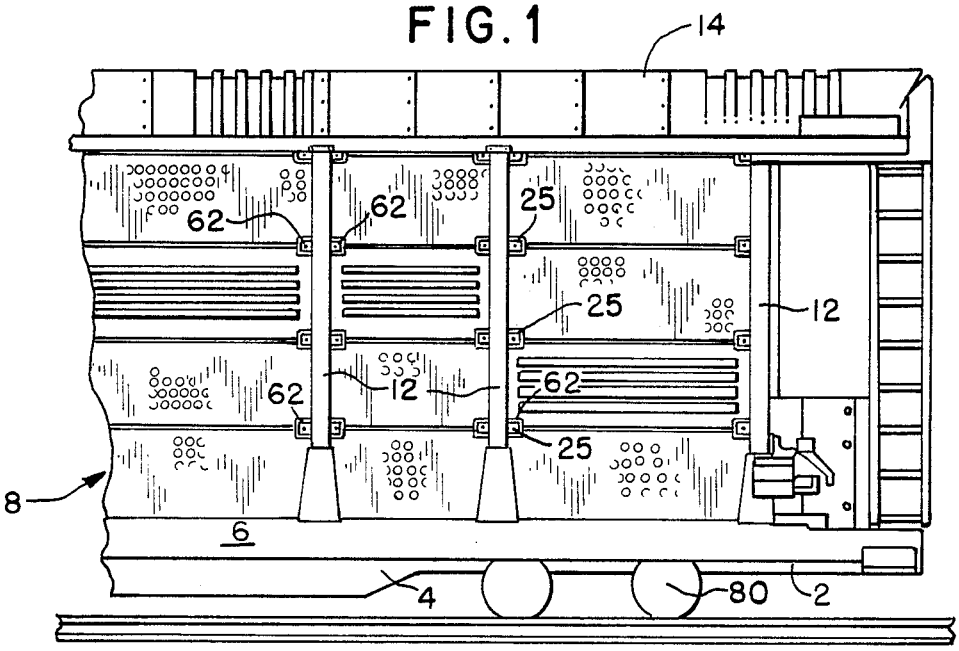
FIG. 2
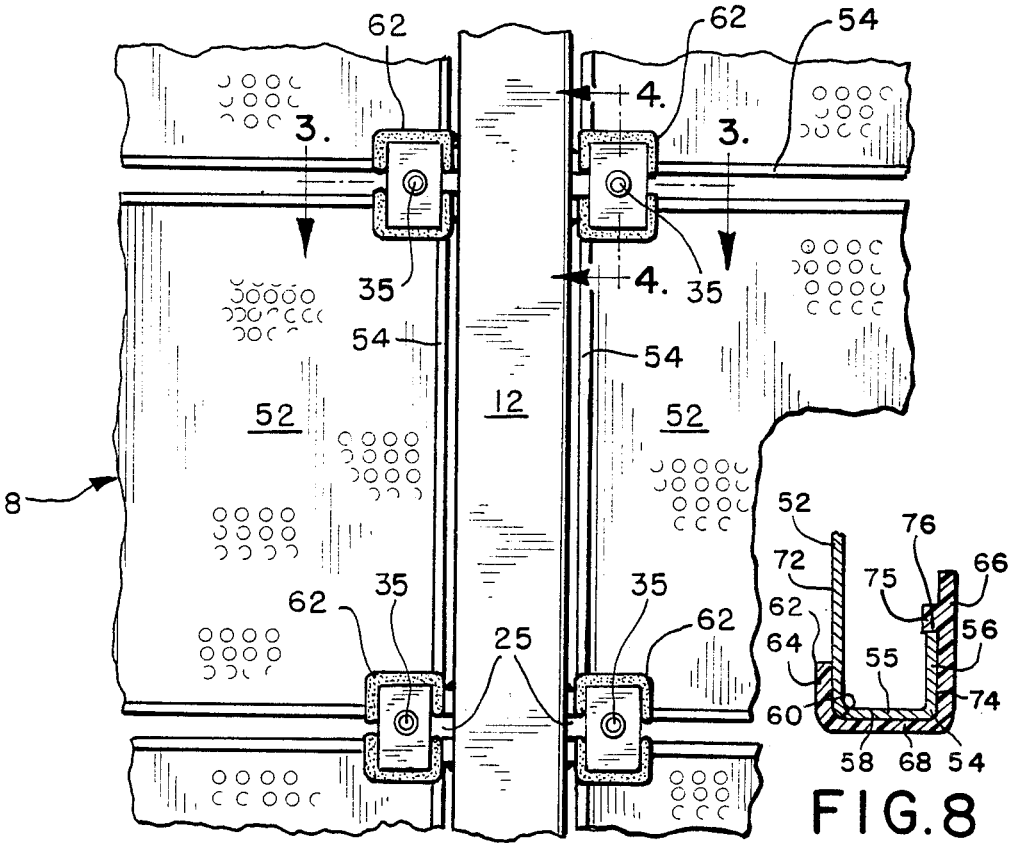
FIG. 8

SIDE PANEL ASSEMBLY FOR AN AUTO RACK CAR

BACKGROUND OF THE INVENTION

This invention appertains to auto rack railway cars which comprises perforated reflective side panels forming the side walls of a car.

The perforated and reflective characteristics of the interior faces of these panels are important in that they increase the visibility inside the car and to thus facilitate loading and unloading of automobiles and trucks with respect to the interior of the car.

One of the serious problems is the discoloration of the panels by rust. A major source of rust discoloration on auto racks can be attributed to the destruction of the interface of the galvanized or painted side panels and the side panel retainers. This interface is subjected to constant movement between the side panels and the retainers due to the flexibility of the rack structure and vibration of the rail car. This movement results in the paint deteriorating on the column brackets producing rust generation points. At the same time the panel movement is gradually removing the protective layer of galvanizing from the side panel introducing additional rust generation points The discoloration of the side panel is more than an aesthetic problem because it also lowers the light reflecting properties of the interior of the auto rack This makes the interior of the auto rack dark enough to cause the operating personnel difficulties in the loading/unloading operations and application of the vehicle restraint systems The resulting safety and damage claims have caused the automobile manufactures to apply a considerable amount of pressure on the railroads to improve the light reflective properties of the interior of auto racks. One result of the pressure is included in the new rack certification program which requires that certified cars be repainted. An additional problem with the rust generated at the interface points is the damage to the finish on new automobiles.

SUMMARY OF THE INVENTION

A broad object is to eliminate the rusting areas by providing a novel plastic insert between the abrading parts of the panel and mounting brackets.

A further object is to provide such insert which can be sleeved onto the corners of the rectangular side panels of the car and fitted within mounting brackets on the vertical posts extending from the bed frame of the car to the roof, the inserts being in the form of corner portions of envelopes of plastic material which envelope the corners of the panels.

These and other objects and advantages of the invention will become more apparent from the specifications and drawings, wherein:

FIG. 1 is a side view of a portion of a railway car incorporating the invention;

FIG. 2 is an enlarged portion of the side panels of a car and mountings therefor;

FIG. 8 is an enlarged cross-section of a portion of the section shown in FIG. 4.

DESCRIPTION OF THE FIGS. 1–8

Figure 3:
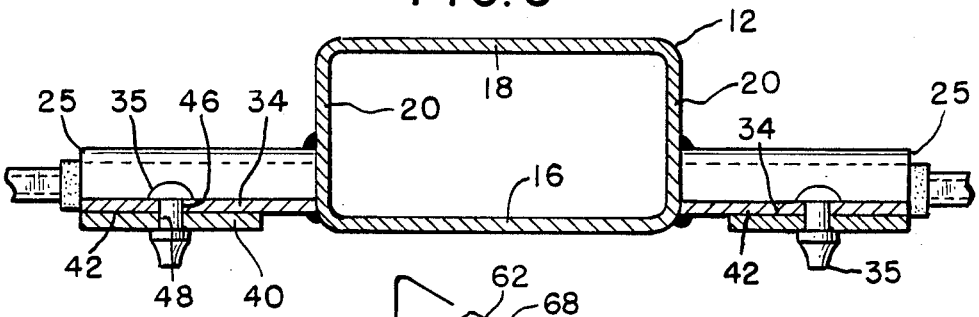
FIG. 3 is a enlarged horizontal cross-section taken on line 3—3 of FIG. 2.

FIG. 1 illustrates a rail car having a bed frame 2 including a center sill 4 and a side sill 6 at each side and side walls 8 comprising a plurality of perforated rectangular panels 10 positioned between upright vertical post 12 which extend from the side sills to a roof 14 and are connected therewith in conventional manner.

Each post 12 is a tubular member having inner and outer vertical walls 16, 18 and fore and aft interconnecting lateral side webs 20, 20.

A plurality of hat shaped mounting brackets 25, 25 are welded along one edge to opposite sides 26, 26 of the column 12 and project lengthwise of the car. Each bracket has a U-shaped intermediate portion 28 with top and bottom horizontal webs 30, 32 and a vertical web 34 interconnecting the webs 30, 32. The free edges of the webs 30, 32 are provided with integral upright flanges 36, 38, flange 38 depending from web 32 and flange 36 upstanding from web 30.

A securing plate 40 is positioned against the exterior side 42 of each web 34 and is secured thereto by a mechanical fastener such as a rivet 35 passing through openings 46,48 in web 34 and plate 40. The securing plates are connected to respective brackets 25 after the wall panels 10 are mounted within the brackets 25 as seen in the drawings.

Figure 4:
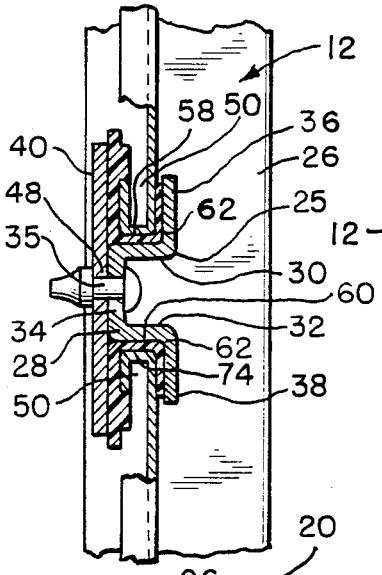
FIG. 4 is a vertical cross-section taken substantially on line 4—4 of FIG. 2.
Figure 5:
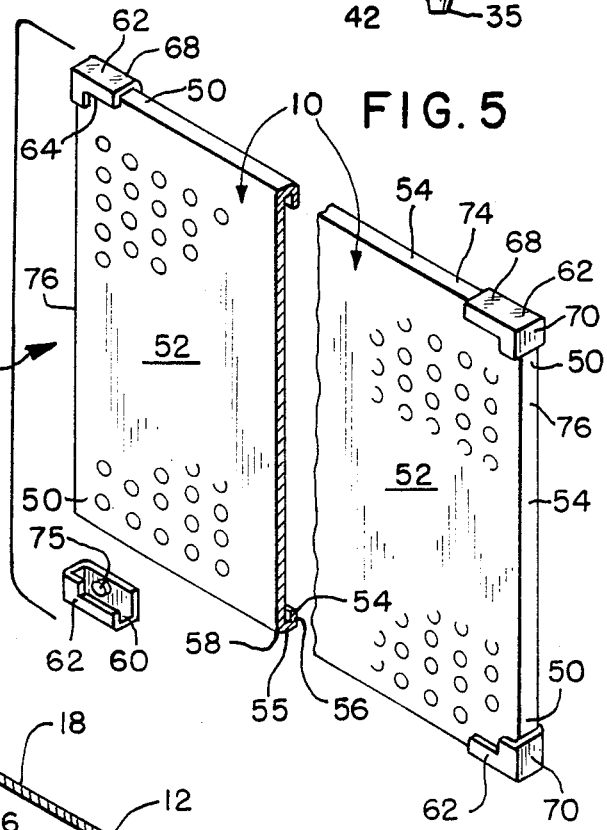
FIG. 5 is a broken apart perspective view of a side panel with the corner protectors applied thereto.
Figure 6:
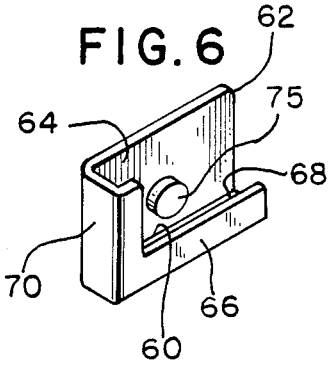
FIG. 6 is a perspective view of the corner protector.
Figure 7:
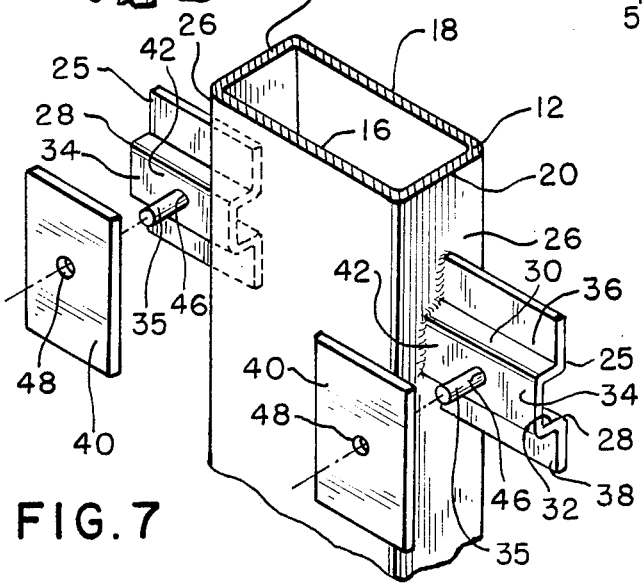
FIG. 7 is an exploded view of the support bracket and mounting post assembly.
Figure 9:
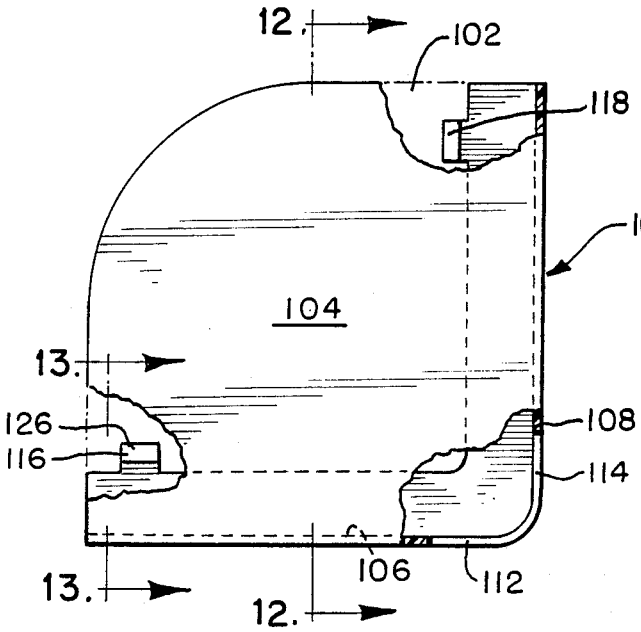
FIG. 9 is a side elevation of a second embodiment of the invention.
Figure 10:
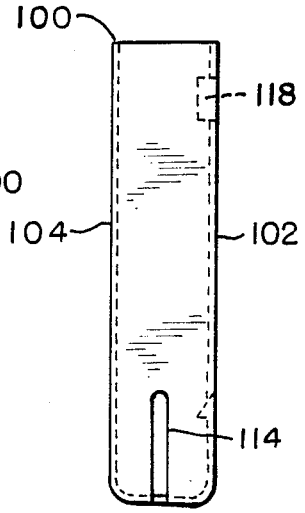
FIG. 10 is an edge view.
Figure 11:
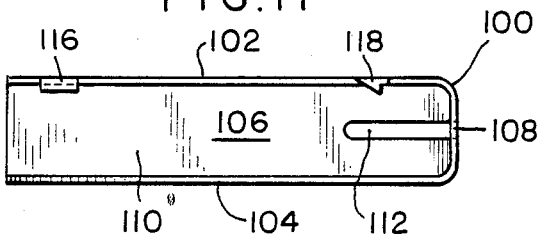
FIG. 11 is a top view.
Figure 12:
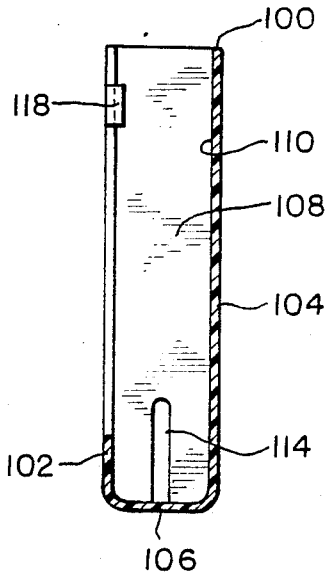
FIG. 12 is a cross-section taken on line 12—12 of FIG. 9.

As best seen in FIGS. 4–6, each panel is of a rectangular shape and has corners 50. The panel has a center perforated or louvered flat plate portion 52 through which light passes into the interior of the car. The center section is formed on its inner side about its periphery with a reinforcing flange 54 having a transverse portion 55 and an inturned flange portion 56 (FIG. 8) forming a wide edge 58 for mounting and reinforcing the panel.

The wide edge 58 is entered at the corners within a complementary pocket 60 of a plastic protector 62 which is U-shaped in cross section and has inner and outer walls 64,66 and transverse interconnecting horizontal and vertical webs 68, 70. The wall 64 seats against the outer side 72 of the panel and the web 66 seats against the external flange 74 of the perimetric flange 54. The vertical web 70 seats against vertical edge 76 of the flange 54 and web 68 seats against the horizontal edge 74 of the flange 54.

The wall 66 is provided with a deformable nib or protrusion 75 which snaps over the edge 76 (FIG. 8) of the flange portion 56 to retain the protector with the panel during installation.

Each protector or jacket fits with its corner within an associated bracket between the securing plate and the respective upright vertical wall 36 or 38 and seats at its vertical and horizontal edges through webs 70, 74 against the respective webs or walls of the associated bracket 25. As each panel is applied and the parts of each bracket are appropriately positioned, they are secured by the respective mechanical fastener such as a rivet 35 within the sockets provided by the brackets.

Thus, as the rail car vibrates and bumps and sways, the panels are held in place through the flexible protectors which are made of suitable materials such as polypropylene or polyethylene or similar resin material. This assembly thus precludes the abrasion previously occasioned and the paint or galvanized cladding is not abraded and does not expose the steel panels to rust corrosion which bleeds onto the inner and outer surfaces of the panels creating the problems heretofore discussed.

The plastic inserts which may be made of self lubricating plastic such as nylon or elastomers to provide tight but flexible mounting which accommodates slight warping. The term plastic includes elastomers materials.

The cars are carried on car trucks 80 in usual manner.

DESCRIPTION OF THE FIGS. 9–13

In this embodiment parts similar to those of the previous embodiment will be identified by the same numerals.

The side panel 10 comprises corners 50 and has a center section 52 formed on its inner side about its periphery with a reinforcing flange 54 having a wide edge transverse section 58 and an inturned flange portion 66 for mounting and reinforcing the panel.

The wide edge 58 is entered at the corners within complementary pockets 100 made of plastic material such as a suitable resin polyethylene of polypropylene and the like.

The pocket or envelope 100 comprises a pair of laterally spaced upright inner and outer side walls 102, 104 and intervening horizontal and vertical transverse webs 106, 108 interconnecting the walls 102, 104 and defining a cavity 110 therewith.

Figure 13:
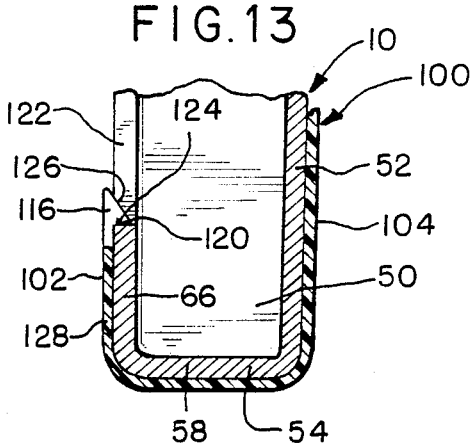
FIG. 13 is a further enlarged cross-section taken on line 13—13 of FIG. 9.

Since the envelope 100 is laterally symmetrical in can be equally applied to the upper or lower or opposite end corners of each panel. The corner juncture of the webs 106, 108 of the webs 106, 108 is slotted to provide water drain slots 112, 114 and the inner wall is provided with latching projections 116, 118 which are adapted to snap over the flat edges 120, 122 of the inboard flange of the panel as seen in FIG. 13.

Each projection 116, 118 has a flat inner edge 124 which extends normal to the flange portion 56 for flat face engagement with the edge 120 or 122. The outer face 126 of each locking protuberance 116 and 118 is sloped between the inner face 128 of the inner side wall and the inner end of face 124 at about a forty five degree angle. The face 126 thus easily wedges over the inner face 128 and deflects the inner wall of the envelope as the envelope is forced onto the corner. When the projections 116, 118 pass beyond the inner edges of the 120 or 122 of the flange portions 66, the projections snap over the edges 120 or 122 and position as shown in FIG. 13 to hold the envelope from slipping off during assembly of the panels with the mounting brackets.

Inasmuch as the envelope is flexible and resilient it can be removed by unlatching the projections from the flange and removing the envelope by the side walls thereof deflecting.

We claim:

1. In an auto rack railway car having a body comprising a roof and an under frame structure and a plurality of upright posts interconnecting the under frame and roof, a plurality of rectangular panels made of rust-prone metal extending between the posts and having corners including horizontal and vertical abutment surfaces contiguous to the posts;

each post having a plurality of panel-mounting brackets including horizontal and vertical abutment surfaces for holding the corners of respective panels;

said brackets having horizontal and vertical surfaces opposing corresponding panel surfaces; and a separate corner piece jacket of flexible plastic material positioned about each of said corners and having side portions compressed between the brackets side surfaces and opposing portions of the panel corners in a substantially shakeproof arrangement.

2. The invention according to claim 1 and means interlocking said jacket with the panel to facilitate assembly thereof with the associated bracket.

3. The invention according to claim 2 and each of said panels having a wall and a laterally spaced flange, said jacket having wall portions embracing the panels and said interlocking means comprising nibs extending from the wall portion of said jacket over the flange of the related panel.

4. The invention according to claim 3 and said jacket being made of plastic.

5. The invention according to claim 1 and said jacket comprising an envelope complemental to the corners of said panels and having a pair of vertical walls embracing said panel therebetween and having an interconnecting portion seated about the edge of the corner and bearing against opposing horizontal and vertical portions of the associated panel mounting bracket.

6. In a railway car, perforated rustable quadrilateral side panels and intervening upright posts defining the sides of the car, said panels having corners, flexible plastic corner piece envelopes confining said corners, and support brackets on said posts comprising corner-accommodating sockets snugly admitting respective corners with their envelopes therein and engaging the same along opposite sides and along vertical and horizontal edges thereof.

7. The invention according to claim 5 and said panel having inside and outside portions, said envelopes each having an inner upright wall extending along the inside of the associated panel and having an upright outer wall extending alongside an outside portion of the respective panel, and said outer wall having a substantially larger area of contact with the panel than said inner wall.

8. The invention according to claim 7 and said plastic being made of flowable plastic or elastomeric material.

9. In a railway car, rustable quadrilateral side panels and intervening upright posts defining the sides of the car, said panels having corners, flexible plastic envelopes confining said corners, and support brackets on said posts comprising corner-accommodating sockets snugly admitted respective corners with their envelopes therein;

and said panel having inside and outside portions, said envelopes each having an inner upright wall extending along the inside of the associated panel and having an upright outer wall extending alongside an outside portion of the respective panel, and said outer wall having a substantially larger area of contact with the panel than said inner wall, said plastic being made of flowable plastic or elastomeric material, said brackets on said posts being vertically aligned and said envelopes being dimensionally larger than the bracket portions in engagement therewith to shield extensive areas of the adjacent portions of the panels from environmental deterioration and rusting.

10. In an auto rack railway car with upright supports and a plurality of side walls of rustable reflective panels each having corners sections including inner and outer abradable surfaces and horizontal and vertical abradable edge surfaces, brackets on the supports having pockets mounting said panels at said corner section and having faces opposing each of said surfaces, anti-abrasion corner piece means mounted within said brackets enveloping said corner sections and intervening each of said surfaces and respective opposing faces in protective relation thereto, means for tightly securing said panels with said anti-abrasion means to the respective brackets.

11. The invention according to claim 10 and said anti-abrasion means comprising a self lubricating plastic.

12. The invention according to claim 11 and said anti-abrasion means comprising envelopes and means interlocking said envelopes with respective corner sections.

13. The invention according to claim 12 and said envelopes being of plastic material.

14. The invention according to claim 12 and said interlocking means comprising peripheral portions on said panels and protrusions on the envelopes overlapping said respective peripheral portions of said panels transverse thereof.

15. An edge portion protection for a normally painted or galvanized corrodible steel panel of a railway side wall car structure, said panel having inner and outer sides and intervening edge portions, said inner side being formed as a flange inturned from the edge portion, and wherein the side wall car structure comprises brackets embracing the edge portions of the panel, the improvement comprising;

anti-abrasion means comprising corner piece envelopes having vertical and horizontal portions interposed between the brackets and said edge portions and providing a sliding fit therebetween preventing abrasion of the paint or galvanizing, and drain means formed in the vertical and horizontal portions of said envelopes for draining water seeping therein

16. The invention according to claim 15 and said anti-abrasion means comprising envelopes of U-shaped cross-section, and said brackets comprising complementary pockets receiving said edge portions with the envelopes thereon.

17. The invention according to claim 16 including projection means on each envelope overlapping the respective inturned flange and securing the envelope thereto.

18. The invention according to claim 15 and said anti-abrasion means comprising a plastic sleeve enveloping said edge portions in tight engagement therewith and with respective brackets, and sad sleeve having means for interlocking the sleeve with the panel.

19. The invention according to claim 18 and said sleeve comprising inner and outer portions overlapping the inner and outer sides of the panel and a transverse portion covering the edge of the panel, and said interlocking means comprising a wedge shaped projection extending from said inner portion and overlapping said inturned flange in interlocking engagement therewith.

20. A protective corner-covering for a panel of a railway car comprising a plastic corner piece member having a pair of panel-embracing side portions and an intervening panel edge-covering portion interconnecting said side portions and developing a pocket for admitting a corner of the panel therein, all of said portions providing anti-abrasion contact surfaces for engagement with a complemental associated support bracket.

21. The invention according to claim 20, and securing means on at least one of said side portions for securing said covering to the panel.

22. The invention according to claim 20, and drain means formed in said edge-covering portion.

* * * * *